US008191380B2

(12) United States Patent
Aragon

(10) Patent No.: US 8,191,380 B2
(45) Date of Patent: Jun. 5, 2012

(54) PORTABLE ACTIVE CRYO CONTAINER

(75) Inventor: Daniel Mark Aragon, Eagle, ID (US)

(73) Assignee: Cold Chain, LLC, Boise, ID (US)

( * ) Notice: Subject to any disclaimer, the term of this patent is extended or adjusted under 35 U.S.C. 154(b) by 1036 days.

(21) Appl. No.: 12/114,926

(22) Filed: May 5, 2008

(65) Prior Publication Data

US 2009/0273265 A1 Nov. 5, 2009

(51) Int. Cl.
*F25D 3/12* (2006.01)

(52) U.S. Cl. ..... 62/384; 62/388

(58) Field of Classification Search ..... 62/384, 62/165, 388
See application file for complete search history.

(56) References Cited

U.S. PATENT DOCUMENTS

| | | | | |
|---|---|---|---|---|
| 2,465,389 | A * | 3/1949 | Morris | 165/259 |
| 2,475,755 | A * | 7/1949 | Pearson | 62/180 |
| 2,550,935 | A * | 5/1951 | Pike | 62/332 |
| 2,580,210 | A * | 12/1951 | Zuckerman | 62/165 |
| 4,038,833 | A | 8/1977 | Foessl | |
| 4,344,291 | A * | 8/1982 | Tyree et al. | 62/62 |
| 4,365,135 | A * | 12/1982 | McWilliams | 219/121.66 |
| 4,502,293 | A | 3/1985 | Franklin, Jr. | |
| 4,891,954 | A | 1/1990 | Thomsen | |
| 5,320,167 | A | 6/1994 | Johnson et al. | |
| 5,363,670 | A | 11/1994 | Bartilucci | |
| 5,598,713 | A | 2/1997 | Bartilucci | |
| 6,003,322 | A | 12/1999 | Graham | |
| 6,226,997 | B1 * | 5/2001 | Vago | 62/130 |
| 6,494,651 | B1 * | 12/2002 | Zhan et al. | 410/116 |
| 6,789,391 | B2 | 9/2004 | Graham et al. | |
| 2001/0039805 | A1 * | 11/2001 | Tavolazzi | 62/125 |
| 2002/0189278 | A1 * | 12/2002 | Defelice et al. | 62/457.2 |
| 2004/0025528 | A1 * | 2/2004 | Gano, III | 62/371 |
| 2005/0188715 | A1 * | 9/2005 | Aragon | 62/371 |
| 2008/0082043 | A1 * | 4/2008 | Janssen | 604/68 |
| 2011/0041411 | A1 * | 2/2011 | Aragon | 49/478.1 |

FOREIGN PATENT DOCUMENTS

DE 3817871 A1 * 12/1989

OTHER PUBLICATIONS

Oxford English Disctionary. Online. "shiplap" entry, found in entry for "ship" retrieved on Jun. 6, 2011 Retrieved from the Internet:<URL:http://www.oed.com/view/Entry/178226?rskey=am2Lcr&result=1&isAdvanced=false#eid123404879>.*

* cited by examiner

*Primary Examiner* — Frantz F. Jules
*Assistant Examiner* — Alexis Cox
(74) *Attorney, Agent, or Firm* — MH2 Technology Law Group, LLP

(57) ABSTRACT

A portable active cryo container for maintaining product at refrigerated and/or cryogenic temperatures. Said container comprising a control system to monitor and control the flow of cooling air from a bunker section to at least one material storage section wherein temperature sensitive product is contained.

22 Claims, 5 Drawing Sheets

PORTABLE ACTIVE CRYO CONTAINER

FIELD OF THE INVENTION

The invention relates generally to an apparatus for refrigerated shipping, and more particularly to containers for keeping product at cryogenic temperatures during transportation of said product.

BACKGROUND OF THE INVENTION

There is a multitude of circumstances which necessitate the use of a temperature controlled container. One of the primary applications is the transportation of goods that require refrigerated or cryogenic temperatures during transit from one place to another. Certain items are in demand far from areas where the items are manufactured or processed. These items require transportation to the site where the items will be used or purchased. If the items are perishable, refrigerating or freezing the item during their transport becomes necessary. These items can include food items, medical items, industrial chemicals that require a cool ambient temperature, and other various perishable goods. There is a need to ship these items in a temperature controlled environment so when the goods reach their destination they maintain their original properties as packaged. Not all items shipped require the same temperature during shipping. Further, there is a need to be able to ship these items within various temperature ranges inside the same container.

Additional objects, advantages and novel features of the invention will be set forth in part in the description which follows; and in part will become apparent to those skilled in the art upon examination of the following; or may be learned by practice of the invention. The objects and advantages of the invention may be realized and attained by means of the combinations particularly pointed out in the appended claims.

SUMMARY OF THE INVENTION

The active cryo container accommodates combination freezer/refrigerator transport. The current invention contains multiple storage areas. Each storage area is capable of maintaining product at a refrigerated or cryogenic temperature independent of the temperature needs of the adjacent material storage sections.

The control system on board the active cryo container monitors and controls each individual material storage section inside the container. If the temperature moves outside user programmed limits, the control system activates a circulating fan associated with the chamber that has moved out of thermal tolerance. When temperatures go back to acceptable levels, the fan is deactivated. The container is constantly monitored and controlled in this manner while the system is active. If the temperature in at least one material storage section goes above preset limits, an alarm will emit a sound informing a user that temperature limits are out of control for the active cryo container. A visual alert can also be displayed if temperature limits are exceeded.

In one embodiment, a battery provides the power needed to run the control system interface. In another embodiment, the active cryo container can have its power supplied from a vehicle's onboard 12 volt power supply. Additionally at least one battery 52 is a removable and rechargeable battery that has the option of being removed to allow simple charging.

A bunker section and the various material storage sections are divided by divider walls. Upon the activation of a circulating fan, cooling air is displaced from the bunker section to various material storage sections depending on thermal needs. This is accomplished by a circulating fan moving the warmer air internal to material storage sections down to bunker section 28.

The bunker section contains a cooling vector material. In the preferred embodiment, this cooling vector material is solid dry ice. Solid dry ice cools the ambient air encompassing it, therefore reducing the temperature in said bunker section. When the circulating fan blows air into the bunker section from the material storage sections through a duct, the air cooled by said dry ice in said bunker section is displaced up to said material storage sections. The actuation of this fan is controlled by said control system when it senses the temperature internal to said material storage sections has gone above preset values.

The purpose of the foregoing summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
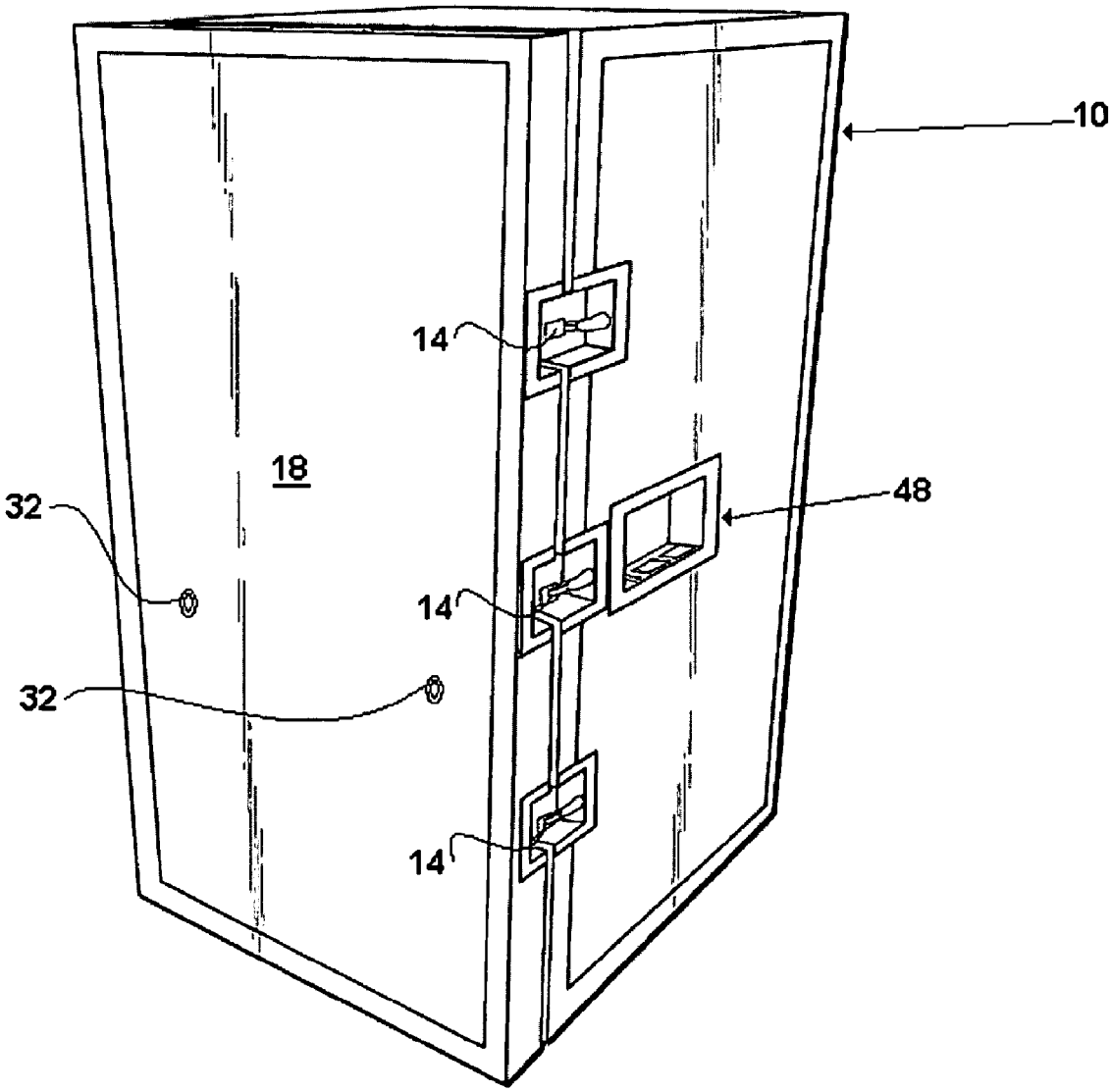
FIG. 1 shows a perspective view of an embodiment of the active cryo container.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The active cryo container accommodates combination freezer/refrigerator transport. The container itself is manufactured with a rugged exterior shell to protect from physical hazards that may arise during transportation. Further, all hardware and control systems are recessed to eliminate damage during loading and transit.

The current invention contains multiple storage areas. Each storage area is capable of maintaining product at a refrigerated or cryogenic temperature independent of the temperature needs of the adjacent material storage sections. Insulated divider walls can be placed into different positions accommodating varying cargo requirements. A divider wall can also be placed on top of the bunker section allowing the entire unit to be used as either refrigerator or freezer depending on temperature requirements.

The control system on board the active cryo container monitors and controls each individual material storage section inside the container. If temperatures move outside user programmed limits, the control system activates a circulating fan associated with the chamber that has moved out of thermal tolerance. When temperatures go back to acceptable levels, the fan is deactivated.

A multiple storage section temperature control system allows the unit to transport products at different temperatures. Systems are programmable to maintain various temperatures from ambient to as cold as −109° F. Built in visual and audible alarms alert users of temperatures that fall outside set ranges. In one embodiment, the control system is powered by a removable and rechargeable battery that has the option of being removed to allow simple charging.

In the following description and in the figures, like elements are identified with like reference numerals. The use of "or" indicates a non-exclusive alternative without limitation unless otherwise noted. The use of "including" means "including, but not limited to," unless otherwise noted.

FIG. 1 illustrates a perspective view of the active cryo container. The outside of the cryo container is protected by protective exterior shell 10. In a preferred embodiment, at least one zero-clearance door 18 provides access into the active cryo container. At least one zero-clearance door 18 is held closed in a closed position by at least one latch 14. In the embodiment shown in FIG. 1, there are three latches 14 used. Latches 14 are recessed in such a way so as to not spatially interfere with objects outside of the active cryo container. Control system interface 48 is mounted on the outside of protective exterior shell 10. Further, control system interface 48 is recessed so as to not spatially interfere with material outside of the actual cryo container. Mounted beneath the active cryo container and outside of protective exterior shell 10, forklift pallet base 16 can be seen. Forklift pallet base 16 is accessed by an outside forklift or lifting device to pick up the active cryo container and manipulate it for storage. In an embodiment, forklift pallet base 16 has tapered lift holes to ensure said portable active cryo container is centered on a forklift before lifting. Flush mount tie down anchors 32 are fixedly attached to the outside of protective exterior shell 10 and are configured to secure said portable active cryo container during transport.

Figure 2:
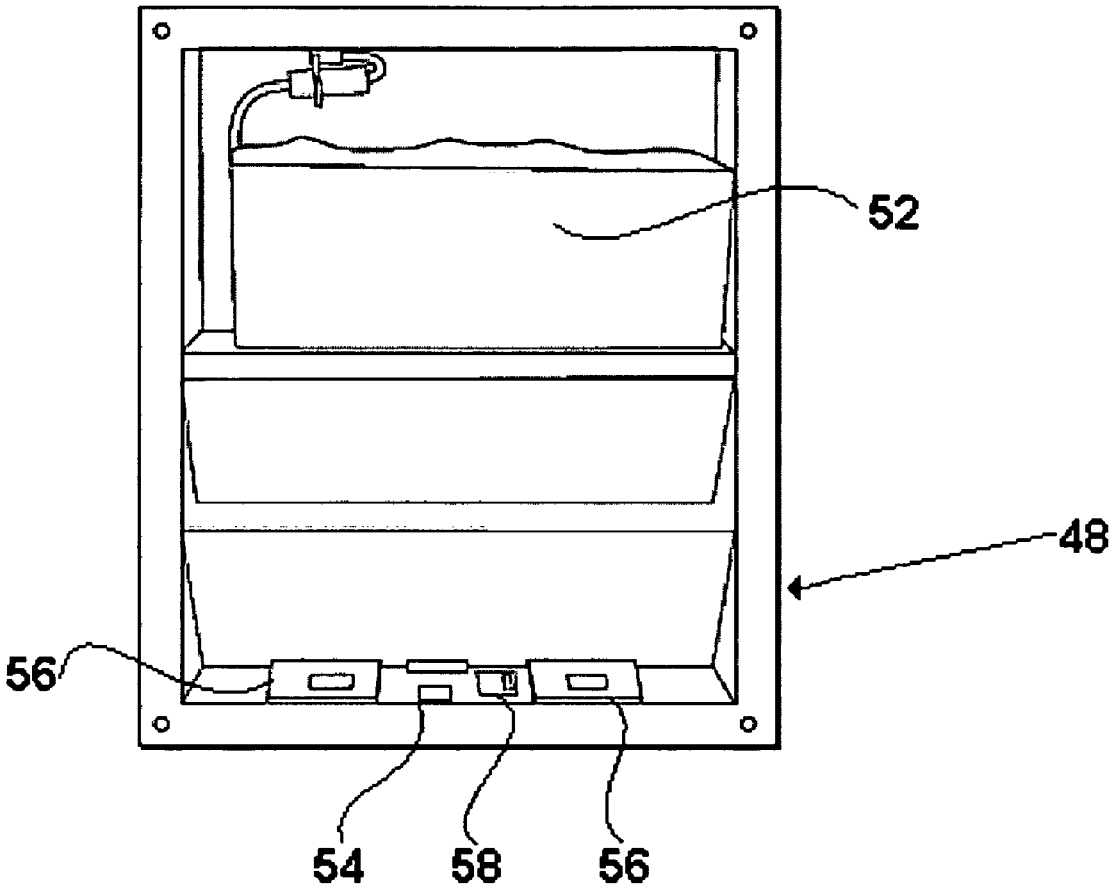
FIG. 2 shows an embodiment of a control system interface for the active cryo container.
Figure 4:
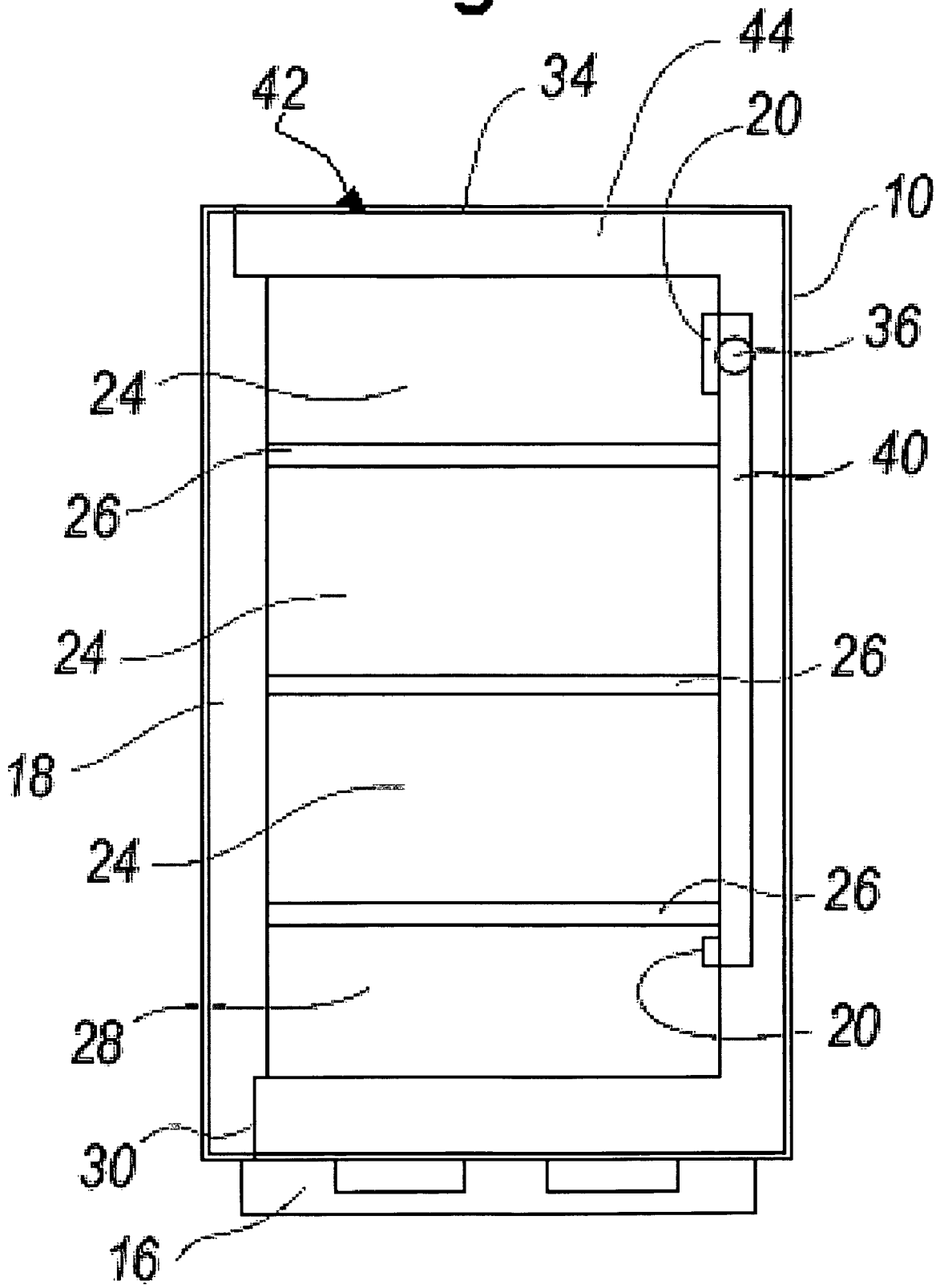
FIG. 4 shows a side cutout view of an embodiment of the active cryo container.

FIG. 2 illustrates an embodiment of a control system interface for the active cryo container. With control system interface 48 a user can input the temperature settings needed for the various material storage sections 24, accurate to within 1 degree Celsius. Said material storage sections 24 are internal to the cryo container as seen in FIG. 4. Control system 48 provides graphical interface 50 that displays at least one temperature readout 56. In the embodiment shown in FIG. 2 there are two temperature readouts 56. Temperature readout 56 displays the temperature of each individual storage section 24. Control system 48 provides at least one toggle switch 54 to activate said control system. In an embodiment battery status gauge 58 displays a representation of the amount of energy stored in at least one battery 52.

If the temperature in at least one material storage section 24 goes above preset limits, alarm speaker 54 will emit a sound informing a user that temperature limits are out of control for the active cryo container. A visual alert will also be displayed if temperature limits are exceeded. Further, said control system is configured to display to the user which material storage section 24 has gone above preset temperature limits. In an embodiment, at least one battery 52 provides the power needed to run control system interface 48. In another embodiment, the active cryo container can have its power supplied from a vehicle's on board 12 volt power supply. Additionally at least one battery 52 is a removable and rechargeable battery that has the option of being removed to allow simple charging.

Figure 3:
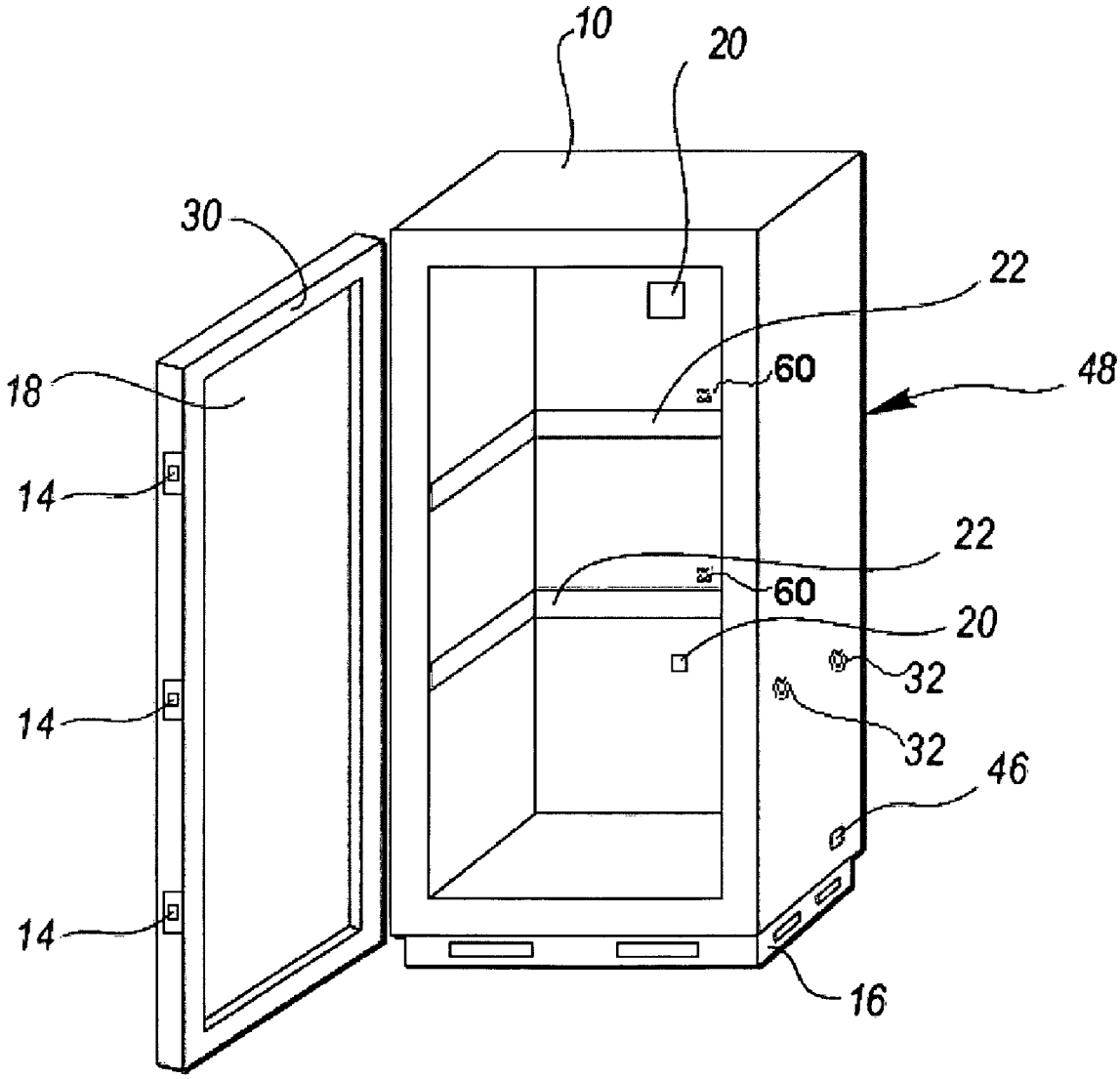
FIG. 3 shows a perspective view of an embodiment of the active cryo container with an open door.

FIG. 3 shows a perspective view of an embodiment of the active cryo container with an open door. On the inside of zero-clearance door 18, door gasket 30 can be seen. When zero-clearance door 18 is closed, door gasket 30 provides a seal that prevents heat exchange between the refrigerated sections internal to the active cryo container and the outside ambient environment. Bunker section 28 and the various material storage sections 24 are divided by divider walls 26 that can be seen in FIG. 4. These divider walls are hung by divider wall supports 22. The divider wall supports 22 can be moved to accommodate a multitude of materials that will need to be stored in the active cryo container. Duct vents 20 can be seen in the active cryo container in FIG. 3. Said vents provide access to duct 40 as can be seen in FIG. 4. In case of over-pressure, pressure relief valve 46 is configured in such a way as to release pressure to the outside atmosphere if conditions inside material storage sections 24 or bunker section 28 rise above preset pressure values.

FIG. 4 shows a side cutout view of the embodiment of the active cryo container. Internal to protective exterior shell 10 but external to material storage section and bunker section 28 is insulative liner section 42. Insulative liner section 42 comprises of vapor barrier 34 and rigid foam 44. Vapor barrier 34 in the embodiment shown in FIG. 4 is external to rigid foam 44. In an embodiment, rigid foam 44 comprises of high density silica stiff foam. This foam is a series of foam panels that are connected via the use of ship-lap joints. Such ship lap joints are thermally sealed with the use of injected non-curing mastic foam. This provides a high quality thermal seal. In the embodiment shown, vapor barrier 34 is a pinhole free vapor barrier comprising of Mylar or aluminum. It is understood that this vapor barrier could be a multitude of other materials.

Internal to rigid foam 44 is duct 40. In duct 40, circulating fan 36 can be seen. In the embodiment shown, circulating fan 36 is a squirrel cage style fan. Upon the activation of circulating fan 36, cooling air is displaced from bunker section 28 to various material storage sections 24. This is accomplished by circulating fan 36 moving the warmer air internal to material storage sections 24 down to bunker section 28.

Bunker section 28 in an embodiment contains a cooling vector material. In this case, this cooling vector material is solid dry ice. Solid dry ice cools the ambient air encompassing it, therefore reducing the temperature in bunker section 28. When circulating fan 36 blows air to bunker section 28 from material storage sections 24 through duct 40, the air cooled by the dry ice in bunker section 28 is displaced up to material storage sections 24. The actuation of this fan is controlled by control system 48 when it senses the temperature internal to material storage sections 24 has gone above preset values previously established. When the internal temperature to material storage sections 24 comes within the preset values, control system 48 will deactivate circulating fan 36, in turn ceasing the transfer of cooling air from bunker section 28 to material storage section 24. Control system 48 uses thermal sensor 60 to determine temperature levels in said material storage sections 24.

Control system 48 continues to monitor the internal temperature of storage sections 24; when, again, the temperature goes above a present limit, control system 48 will activate circulating fan 36, once again cooling off material storage sections 24. In another embodiment (not shown), multiple ducts 40 and cooling fans 36 can be assigned to various material storage sections 24 to control each individual material storage section independent of each other. Therefore, multiple material storage sections can be assigned multiple temperature values in which control system 48 will continue to monitor and keep within temperature limits through the activation and deactivation of each assigned circulating fan 36 to the individual material storage sections 24.

Figure 5:
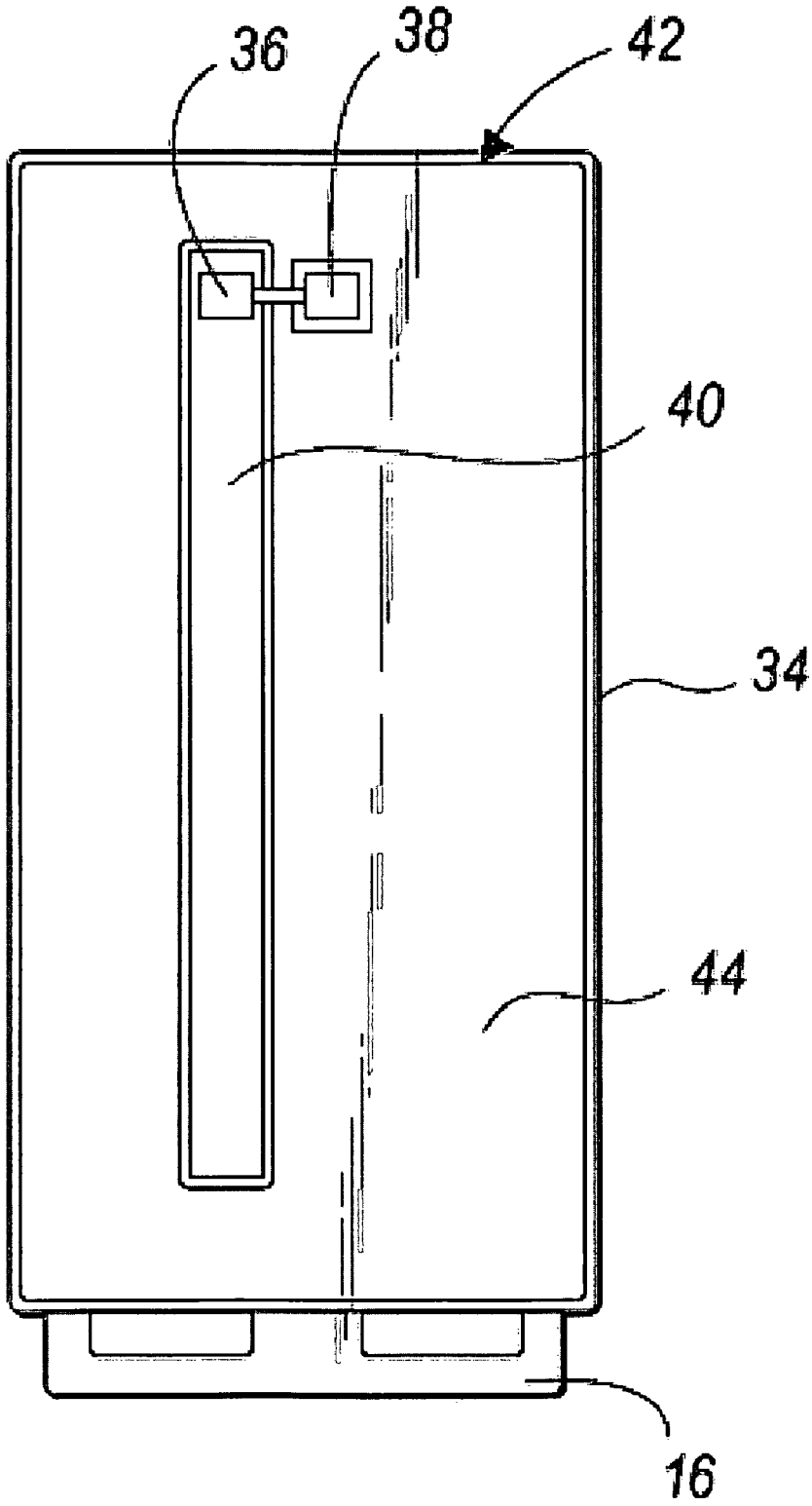
FIG. 5 shows a rear cutout view of an embodiment of the active cryo container.

FIG. 5 shows a rear cutout view of the embodiment of the active cryo container. As can be seen in FIG. 5, duct 40 is internal to rigid foam 44. Low temperature motor 38 is driven by control system 48 to activate circulating fan 36 upon preset temperatures sensed internal to the various material storage sections 24. Low temperature motor 38 is held within a separate compartment than the circulating fan 36. Circulating fan 36 is internal to duct 40, however, low temperature motor 38 is not. Low temperature motor 38 is not within the flow of the cooling air moved by circulating fan 36. In doing this, low temperature motor 38 does not become introduced to the extreme cool environments that circulating fan 36 does. This allows low temperature motor 38 to actuate the circulating fan 36 in temperatures down to −109° F. for as many as 36 days.

In an embodiment, all ducting fans and control systems and power requirements are mounted inside zero-clearance door 18. This allows for rapid repair should a system malfunction as to the door just needs to be replaced to rectify the malfunction.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. Hence, the foregoing description should not be construed to limit the scope of the invention, which is defined in the following claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A portable active cryo container, comprising:

a protective exterior shell, for enclosing and protecting contents and components of said cryo container;

an insulative liner section internal to said protective exterior shell, wherein said insulative liner section is configured to impede the transfer of thermal energy;

a plurality of material storage sections defined by said insulative section and by divider walls, wherein each of said plurality of material storage sections are configured to contain storage material and maintain said storage material at a user defined temperature, with each section being configured to maintain a temperature independent of the other sections;

at least one bunker section defined by said insulative liner section, wherein said at least one bunker section is configured to contain a volume of solid dry ice;

at least one circulating fan driven by an insulated low temperature motor, wherein said fan is configured to push air from said material storage section to said bunker section in a manner that would allow a resultant flow of cool air from said bunker section to said material storage section to maintain a predetermined temperature level in said material storage section;

a plurality of air ducts configured to allow air within said at least one material storage section and said at least one bunker section to circulate between said sections as a response to the activation of said at least one circulating fan, wherein the fan is positioned in an air duct that is internal to the insulative liner and wherein the motor is recessed in the insulative liner section outside of the flow of air through the duct;

at least one door providing access to said portable active cryo container, wherein said door is insulated; and at least one control system, configured to control the temperature level in said at least one material storage section to a preset level by actively sensing the temperature of said at least one material storage section and responding to fluctuation of said sensed temperature by modulating the activation of said at least one circulating fan.

2. The portable active cryo container of claim 1, further comprising a vapor barrier liner comprising a substantially pinhole free vapor barrier material.

3. The portable active cryo container of claim 1, in which said air ducts are defined in said insulative liner section and lined with a vapor barrier material.

4. The portable active cryo container of claim 1, wherein said protective exterior shell is comprised of steel.

5. The portable active cryo container of claim 1, wherein said protective exterior shell is comprised of aluminum.

6. The portable active cryo container of claim 1, wherein said protective exterior shell is mounted to a forklift pallet base, wherein said forklift pallet base is configured to allow the access of forklift tongues on all 4 sides.

7. The portable active cryo container of claim 6, wherein said forklift pallet base is tapered and configured to guide a lifting apparatus to center under said portable active cryo container.

8. The portable active cryo container of claim 1, wherein said insulative liner comprises panels that interface together using ship lap joints.

9. The portable active cryo container of claim 8, wherein said ship lap joints are connected using injected, non-curing mastic foam.

10. The portable active cryo container of claim 1, further comprising a plurality of flush mount tie down anchors, said flush mount tie down anchors are mounted to the exterior of said generally cuboid protective exterior shell and configured to interface with securing media during transport of said portable active cryo container.

11. The portable active cryo container of claim 2, wherein said substantially pinhole free vapor barrier is comprised of Mylar.

12. The portable active cryo container of claim 2, wherein said substantially pinhole free vapor barrier is comprised of aluminum.

13. The portable active cryo container of claim 1, wherein said at least one material storage section further comprises a pressure relief valve ducted to the exterior of said protective exterior shell, wherein said pressure relief valve is configured to expel pressure in said at least one material storage section if pressure in said at least one material storage section goes beyond predetermined levels.

14. The portable active cryo container of claim 1, wherein said at least one door comprises a silicone door gasket, wherein said gasket is sandwiched between said at least one door and said generally cuboid protective exterior shell when the door is actuated to the closed position.

15. The portable active cryo container of claim 1, wherein said at least one digital control system comprises a user interface console mounted on the exterior of said generally cubic protective exterior shell, recessed in a such a manner that said console will not spatially interfere with the area surrounding the exterior of said generally cuboid protective exterior shell.

16. The portable active cryo container of claim 1, wherein said active cryo container is powered by at least one onboard battery.

17. The portable active cryo container of claim 1, wherein said active cryo container is powered by a peripheral power supply.

18. The portable active cryo container of claim 1, wherein said at least one control system comprises;

at least one graphical user interface configured to provide temperature levels in readable format, and for a user to supply temperature parameters for at least one said material storage section; and at least one audible alarm configured to emit an audible warning if said at least one material storage section's temperature level goes above or below preset limits.

19. The portable active cryo container of claim 16, wherein said control system, said at least one battery, said fan, and said air ducts are all incorporated within said at least one door.

20. The portable active cryo container of claim 1, wherein the door is configured to need spatial clearance only on one side of the door.

21. A portable active cryo container, comprising:

a generally cuboid protective exterior shell, for enclosing and protecting contents and components of said cryo container;

an insulative liner section internal to said protective exterior shell, wherein said insulative liner section is configured to impede the transfer of thermal energy;

at least one bunker section defined by said insulative liner section, wherein said at least one bunker section is configured to contain a volume of solid dry ice;

a plurality of material storage sections defined by said insulative liner section and by divider walls, wherein each of said plurality of material storage sections are configured to contain storage material and maintain said storage material at a user defined temperature, with each section being configured to maintain a temperature independent of other sections;

at least one circulating fan driven by an insulated low temperature motor, wherein said fan is configured to push air from said material storage section to said bunker section in a manner that would allow a resultant flow of cool air from said bunker section to said material storage section to maintain a predetermined temperature level in said material storage section;

a plurality of air ducts configured to allow air within said at least one material storage section and said at least one bunker section to circulate between said sections as a response to the activation of said at least one circulating fan;

at least one door providing access to the cryo container; and at least one control system, configured to control the temperature levels in said plurality of material storage sections by actively sensing the temperature of said plurality of material storage sections and responding to fluctuation of said sensed temperature by modulating the activation of said at least one circulating fan.

22. The portable active cryo container of claim 19, wherein the door is configured to need spatial clearance only on one side of the door.

* * * * *